United States Patent [19]

Joseph

[11] 4,072,486

[45] Feb. 7, 1978

[54] SEE-THROUGH, SMOKED GRAY, PLEXIGLASS REFRIGERATOR DOOR

[76] Inventor: Ruth Joseph, 153 Brabant St., Apt. 5C, Staten Island, N.Y. 10303

[21] Appl. No.: 738,294

[22] Filed: Nov. 3, 1976

[51] Int. Cl.[2] ..... F25D 23/02

[52] U.S. Cl. ..... 62/131; 62/264; 312/223

[58] Field of Search ..... 62/248, 264, 246, 131, 62/265, 255, 446; 312/223; 52/616; 126/200; 240/2 PA, 2 AD, 46.59, 5

[56] References Cited

U.S. PATENT DOCUMENTS

| | | | |
|---|---|---|---|
| 2,279,558 | 4/1942 | Clerc | 62/131 X |
| 2,758,197 | 8/1956 | Evans et al. | 240/5 |
| 3,283,531 | 11/1966 | Horvay et al. | 62/446 X |

FOREIGN PATENT DOCUMENTS

| | | | |
|---|---|---|---|
| 363,825 | 12/1931 | United Kingdom | 62/246 |

*Primary Examiner*—William E. Wayner
*Attorney, Agent, or Firm*—Richard L. Miller

[57] ABSTRACT

A refrigerator is disclosed having a door on its front side and which is made of transparent, smoked gray plexiglass so that a person can see through the door and into the interior of the refrigerator, thus being able to seek for an item of food before opening the door so to conserve electrical energy, and the outer side of the door having a switch button to turn on the light inside the refrigerator while the door is closed so to illuminate the interior.

1 Claim, 3 Drawing Figures

32
33
34
10
31
30
MILK
29
14
13
24
12
19
11

24
15
21
19
10
20
28
14
16
18
23
22
17

12
23
10
27
28
25
26
14

SEE-THROUGH, SMOKED GRAY, PLEXIGLASS REFRIGERATOR DOOR

This invention relates generally to electrically operated refrigerators such as are used in a home.

It is generally well known that upon occassion a person cannot quickly locate a particular item of food inside a refrigerator so that while he is hunting for the same, the refrigerator door is kept open, which dissipates the cool air outwardly so that this thermal loss then causes the refrigerating mechanism to start up so to replace the loss of coldness. Opening the door in such manner frequently and for long periods results in an increase of electrical energy consumed so that it reflects in an increase in the electric bill of a household. This situation is objectionable and is therefore in want of an improvement.

Accordingly, it is a principal object of the present invention to provide a refrigerator having a transparent front door through which a person can see so to locate items before opening the door, thus keeping the door open for only a minimum length of time thereafter.

Another object is to provide a see-through, smoked gray, Plexiglass refrigerator door having a switch button on its outside so a person can light up the refrigerator interior while the door is still closed so to find a particular item.

Still another object is to provide a see-through, smoked gray, Plexiglass refrigerator door which can be made to replace conventional doors of existing home refrigerators, as well as being incorporated into new refrigerators while being manufactured.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Figure 1:
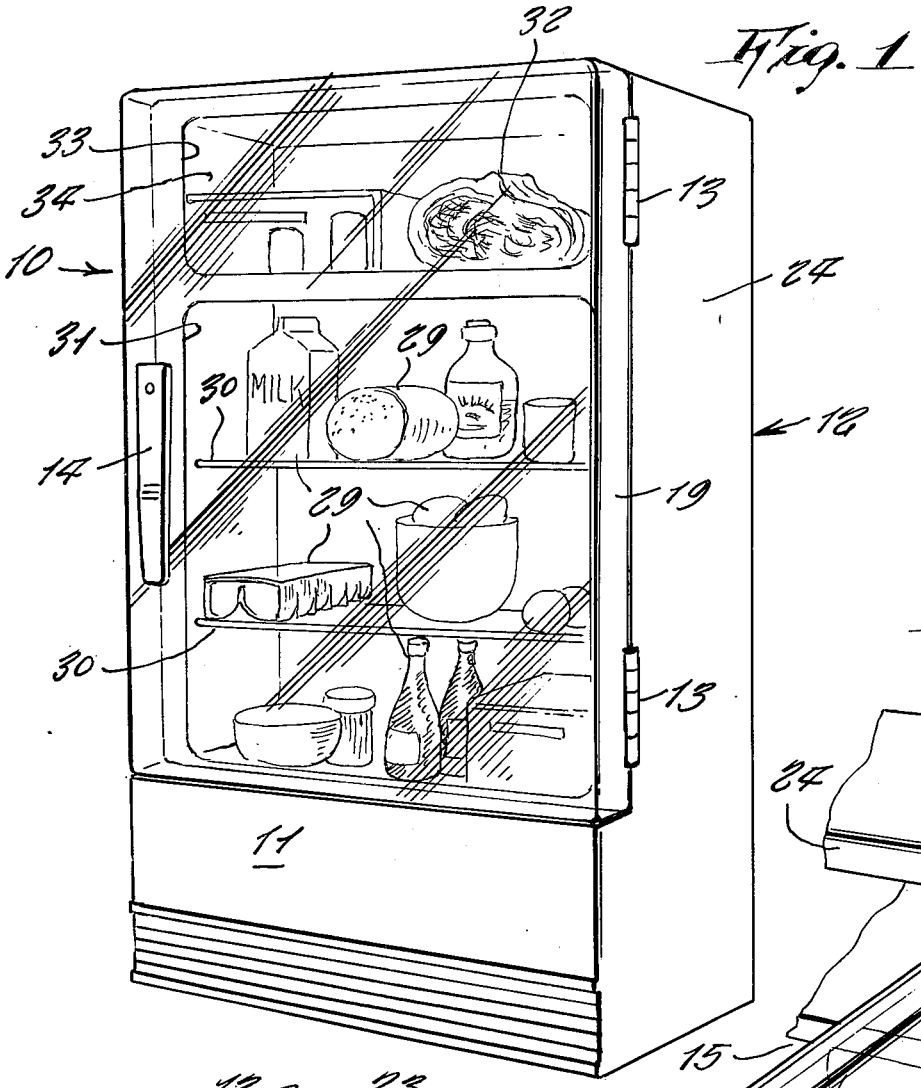
FIG. 1 is a perspective view of a refrigerator incorporating a see-through, smoked gray, Plexiglass door, shown closed.
Figure 2:
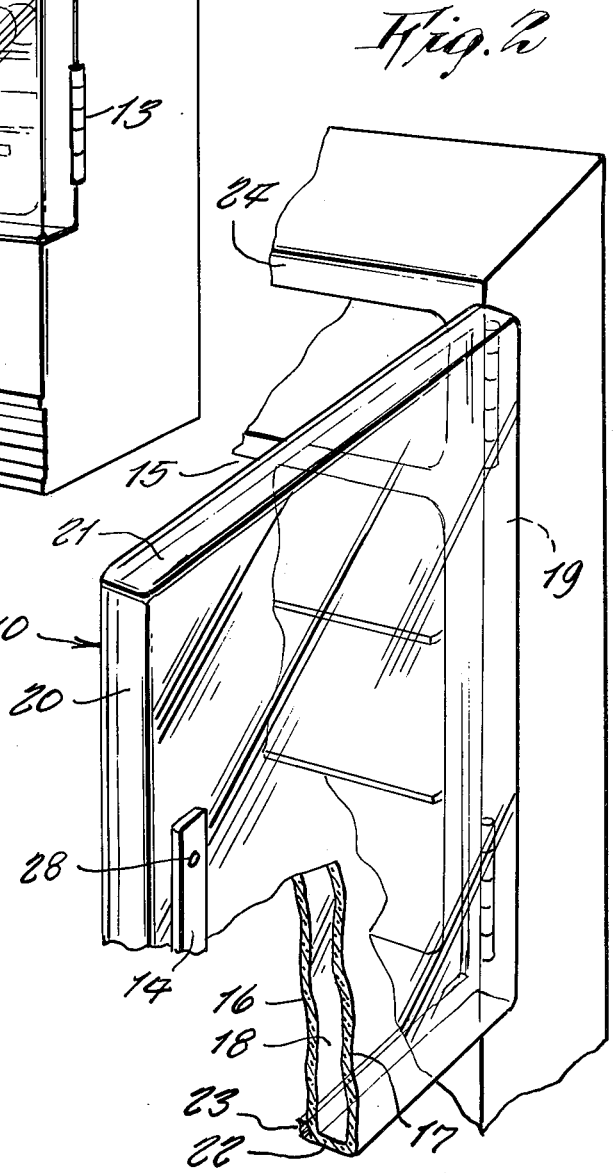
FIG. 2 is a fragmentary similar view with the door opened and showing the door construction.

Referring now to the drawing in greater detail, the reference numeral 10 represents a see-through, smoked gray, Plexiglass, refrigerator door according to the present invention and which is installed on a front side 11 of a home refrigerator 12. The door is pivotally mounted on hinges 13 along one vertical side edge, and includes a handle 14 along an opposite vertical side edge for pulling the door open, so to gain access to the refrigerator interior 15.

The door includes parallel inner and outer walls 16 and 17 having a sealed insulating air space 18 therebetween. The edges of the walls 16 and 17 are accordingly integral with opposite side edge walls 19 and 20 as well as upper and lower edge walls 21 and 22 for hermetically sealing the space 18. A rubber gasket 23 is secured to a peripheral area of the inner wall 16 for abutting against the metal case 24 of the refrigerator; the gasket being impregnated with permanent magnet particles for holding the door in a closed position, in a manner of conventional refrigerators.

The door, thus manufactured in one integral piece, is molded from smoked gray, Plexiglass material so to permit seeing therethrough while yet being of a soft subtle hue so to keep exterior light from penetrating therethrough and also not readily and clearly displaying the food content of the refrigerator when not wanted to be seen.

Figure 3:
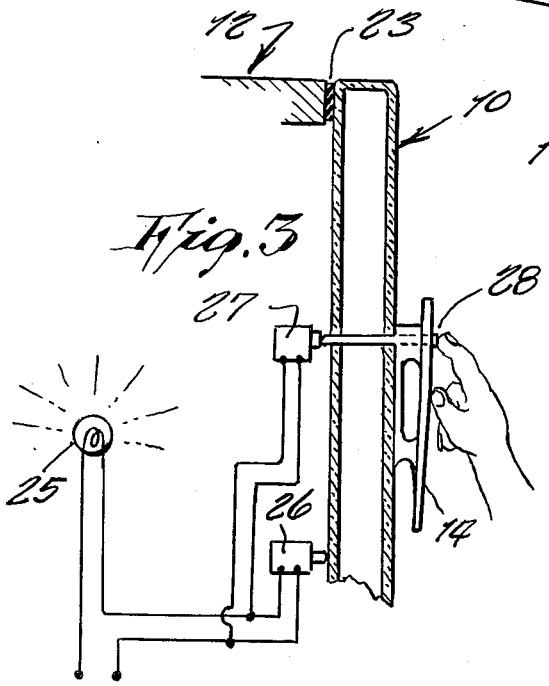
FIG. 3 is a diagram showing that an external push button can be provided to illuminate the refrigerator interior prior to opening the door so to locate specific items before the door is opened.

As shown in FIG. 3, a lamp 25 conventionally operated automatically by a switch 26 when the door is opened, is also operated manually in the present invention by a switch 27 activated by a push button 28 on a front side of the door handle; the switches being in parallel circuits to each other.

In operative use, it is now evident that a person can see through the door 10 so to see food 29 placed upon shelves 30 of the cooler compartment 31. Also food 32 can be seen inside the freezer compartment 33 if this compartment also includes a seethrough front door 34 made similarly to door 10, as shown in FIG. 1.

For better visibility of the refrigerator interior, the lamp 25 can be lighted by simply depressing the switch button 28.

Thus a more attractive, more useful and more modern looking refrigerator door is provided.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A household refrigerator including a case having a cooler compartment and a freezer compartment cooled by a refrigerating mechanism, and a front door of said refrigerator being made from a transparent Plexiglass material that is tinted smoke gray so that visibility therethrough is not readily clear from an outside when an interior of said refrigerator is not illuminated; said door including a sealed, central, air space insulation between inner and outer wall thereof; said door being mounted upon hinges and including a pull handle, a magnet-impregnated gasket mounted on an inner side of said door for abuttment with a metal front face of said refrigerator case; a lamp inside said case being in a circuit with a first switch automatically operated when said door is opened and is also in a circuit with a second switch manually operated by a pushbutton on an outer side of said door, said lamp providing illumination means inside said refrigerator so to allow clear visibility readily through said transparent, smoke gray Plexiglass door.

* * * * *